US009770809B2

(12) United States Patent
Ribic, Jr. et al.

(10) Patent No.: US 9,770,809 B2
(45) Date of Patent: Sep. 26, 2017

(54) VISE PARALLEL RETAINING DEVICE, IT'S USE, AND VISE PARALLEL RETAINING DEVICE KIT

(71) Applicant: Rimeco Products, Inc., Willoughby, OH (US)

(72) Inventors: John Ribic, Jr., Kirtland, OH (US); John Ribic, Sr., Chagrin Falls, OH (US); Joseph Ribic, Willoughby, OH (US); Rok Ribic, Kirtland, OH (US)

(73) Assignee: Rimeco Products, Inc., Willoughby, OH (US)

( * ) Notice: Subject to any disclaimer, the term of this patent is extended or adjusted under 35 U.S.C. 154(b) by 0 days.

(21) Appl. No.: 14/951,635

(22) Filed: Nov. 25, 2015

(65) Prior Publication Data

US 2016/0144487 A1 May 26, 2016

Related U.S. Application Data

(60) Provisional application No. 62/083,944, filed on Nov. 25, 2014.

(51) Int. Cl.

| | |
|---|---|
| ***B25B 5/16*** | (2006.01) |
| ***B25B 1/24*** | (2006.01) |
| ***B25H 3/00*** | (2006.01) |

(52) U.S. Cl.

CPC ..... *B25B 1/2463* (2013.01); *B25H 3/006* (2013.01)

(58) Field of Classification Search

USPC ..... 269/43, 156, 277, 254 CS

See application file for complete search history.

(56) References Cited

U.S. PATENT DOCUMENTS

| | | | | |
|---|---|---|---|---|
| 2,954,713 | A * | 10/1960 | Gaubert | B25B 1/06 269/196 |
| 3,151,860 | A * | 10/1964 | Dosal | D06F 71/40 223/70 |
| 3,891,201 | A | 6/1975 | Clugage | |
| 4,558,856 | A | 12/1985 | Shaffer | |
| 5,222,997 | A | 6/1993 | Montgomery | |
| 5,276,975 | A * | 1/1994 | Fisher | G01B 5/25 33/626 |
| 5,538,251 | A * | 7/1996 | Harper | A63B 69/365 473/229 |
| 2009/0020937 | A1* | 1/2009 | Odell | B25B 1/2468 269/271 |
| 2012/0102714 | A1* | 5/2012 | Scheinberger | F16B 19/1063 29/509 |

* cited by examiner

*Primary Examiner* — Joseph J Hail
*Assistant Examiner* — Shantese McDonald
(74) *Attorney, Agent, or Firm* — Edwin A. Sisson, Attorney at Law, LLC; Jeffrey J. Banyas

(57) ABSTRACT

This specification discloses a holder device for retaining a pair of parallels against a pair of vise jaws, a method of using said holder device, and a holder device kit. The holder device comprises a compressible member and an incompressible member. The compressible member has a compressible member first end, a compressible member second end, and a compressible member length dimension. The incompressible member has an incompressible member first end, an incompressible member second end, and an incompressible member length dimension. The compressible member second end and the incompressible member first end are connected to form the holder device.

13 Claims, 9 Drawing Sheets

VISE PARALLEL RETAINING DEVICE, IT'S USE, AND VISE PARALLEL RETAINING DEVICE KIT

PRIORITY AND CROSS REFERENCES

This application claims priority from U.S. Provisional Application No. 62/038,944 filed on 25 Nov. 2014, the teachings of which are incorporated herein by reference in their entirety.

BACKGROUND

There are multiple options for keeping vise parallels apart. It is common to use a simple spring in small width work-piece applications. In practice, the machinist stores a variety of springs of different lengths in a large collection bin and wastes a large amount of time trying to find the correct spring among the random springs compiled in the bin. There are several alternatives to springs.

As described in U.S. Pat. No. 5,222,997 to Montgomery published in 1993 a vise is commonly used to secure work-pieces to be machined. In order to secure such work-pieces within the vise, a pair of thin, flat plates known as parallels may be used. Parallels commonly consist of metal plates of varying length and width dimensions and thicknesses. The parallels are mounted between the vise jaws and the work-piece rests on top of the parallels and between the vise jaws. Parallels serve to mount the work-piece in an exact location and may serve as a guide for a machining operation.

U.S. Pat. No. 4,558,856 to Shaffer ("Shaffer") discloses a holder for retaining a pair of parallels against the jaws of a vise. Shaffer's device makes use of a U-shaped spring body that pivotally attaches to a pair of end members which engage the parallels. Another device as found in U.S. Pat. No. 3,891,201 to Clugage ("Clugage") reveals a method for securing work-pieces by means of a hold down element; however, no resilient holding mechanism is disclosed.

U.S. Pat. No. 5,222,997 to Montgomery ("Montgomery") published in 1993 teaches a holder device for selectively positioning and retaining a pair of parallels at a selected position against the opposed jaws of a vise found on a milling machine, drill press or the like. The holder device includes stationary and movable retaining members in the form of flat plates and a guide arrangement for maintaining the retaining members parallel during movement between extended and retracted positions. The guide arrangement includes two parallel spaced inner tubes attached at adjacent ends to the stationary retaining member and extending perpendicular to the length of the inner tubes together with a pair of parallel spaced outer tubes attached at adjacent ends of the second retaining member and perpendicular thereto. The outer tubes telescope over the inner tubes to provide parallel positioning for the retaining members. A force applying or bias is provided in each of the inner tubes causing the two retaining members to move to a separated extended position of maximum spacing. When an inward force is applied against the retaining member in the direction of the tube length, the retaining plate moves to a closer position so that when between a pair of vise jaws the retaining members resiliently urge a pair of parallels against the vise jaws.

The holder device disclosed in Montgomery is the current state of the art for holding parallels apart in a vise as indicated by the fact that it is believed by the inventors that the device is the primary device used and sold in the United States for this purpose. As indicated in the various blogs, the commercial embodiment of Montgomery lacks various features. While it functions, it is complicated and is replaced often.

There exists therefore a need for a simpler, yet more robust solution and kit for use in a machine shop.

FIELD OF INVENTION

This invention relates generally to holder devices and more particularly to holder devices for positioning and retaining a pair of parallels against a pair of vise jaws.

SUMMARY OF INVENTION

Figure 1A:
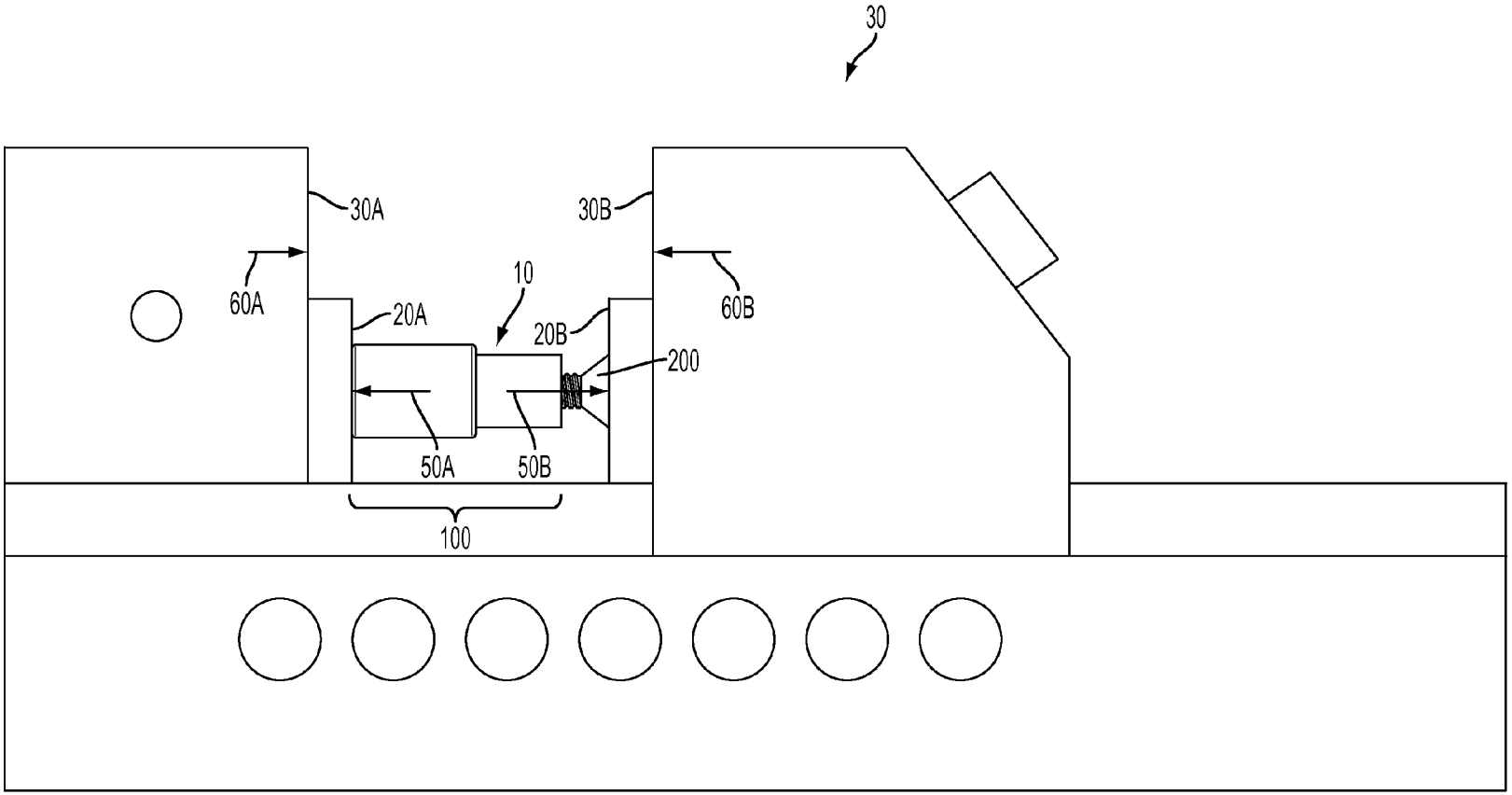
FIG. 1A is a side view of a holder device in use.

Disclosed herein is a holder device capable of providing opposing retaining forces on a pair of parallels when the holder device is compressed between the pair of parallels against a pair of vise jaws; said holder device comprising:

- a compressible member having a compressible member first end, a compressible member second end that is opposite said compressible member first end, and a compressible member uncompressed length dimension;
- an incompressible member having an incompressible member first end, an incompressible member second end that is opposite said incompressible member first end, and an incompressible member length dimension; and wherein the compressible member second end and the incompressible member first end are connected to form the holder device having a holder device length dimension.

In one embodiment, the connection of the compressible member second end and the incompressible member first end is an adjustable connection so that the holder device length dimension can be varied.

In one embodiment, the compressible member is a spring and the incompressible member is a rod.

In one embodiment, the compressible member comprises a housing comprising a housing first end, a housing second end that is opposite the housing first end, and a housing length dimension; a spring; and a plunger comprising a plunger first end, a plunger second end that is opposite the plunger first end, and a plunger length dimension. In such an embodiment the housing first end encompasses the plunger second end, the housing encompasses the spring, and the plunger second end interacts with the spring inside the housing when the holder is under compressive forces.

The compressible member second end may further comprise female threads while the incompressible member further comprises male threads beginning at the incompressible member first end and running at least a portion of the incompressible member length dimension. The adjustable connection may therefore be a threaded connection wherein the male threads of the incompressible member are mated to the female threads of the compressible member second end.

The compressible member second end may further comprise male threads while the incompressible member further comprises female threads beginning at the incompressible member first end and running at least a portion of the incompressible member length dimension. The adjustable connection may therefore be a threaded connection wherein the female threads of the incompressible member are mated to the male threads of the compressible member second end.

The compressible member may be a spring with female threads on the compressible member second end and the incompressible member may be a rod with male threads starting on the incompressible member first end and running at least a portion of the incompressible member length dimension. In such an embodiment, the male threads are mated to the female threads so as to adjust the distance from the incompressible member first end to the incompressible member second end.

In one embodiment, there are female threads on at least one of the housing second end or the plunger first end while the incompressible member is a rod having male threads starting on the incompressible member first end and running at least a portion of the incompressible member length dimension. In such an embodiment, the male threads are mated to the female threads so as to adjust the distance from the incompressible member first end to the incompressible member second end.

In one embodiment, the housing has an outside perimeter which is not circular. The housing may have at least one flat side in a direction parallel to the housing length dimension.

In one embodiment, the incompressible member is made of a material selected from the group consisting of metal or plastic. The incompressible member may further comprise a coating with preferred coatings selected from the group consisting of black phosphate coatings and black oxide coatings.

In one embodiment, the housing and the plunger are made of a material selected from the group consisting of metal or plastic. The housing and the plunger may further comprise a coating with preferred coatings selected from the group consisting of black phosphate coatings and black oxide coatings.

DETAILED DESCRIPTION

Figure 1B:
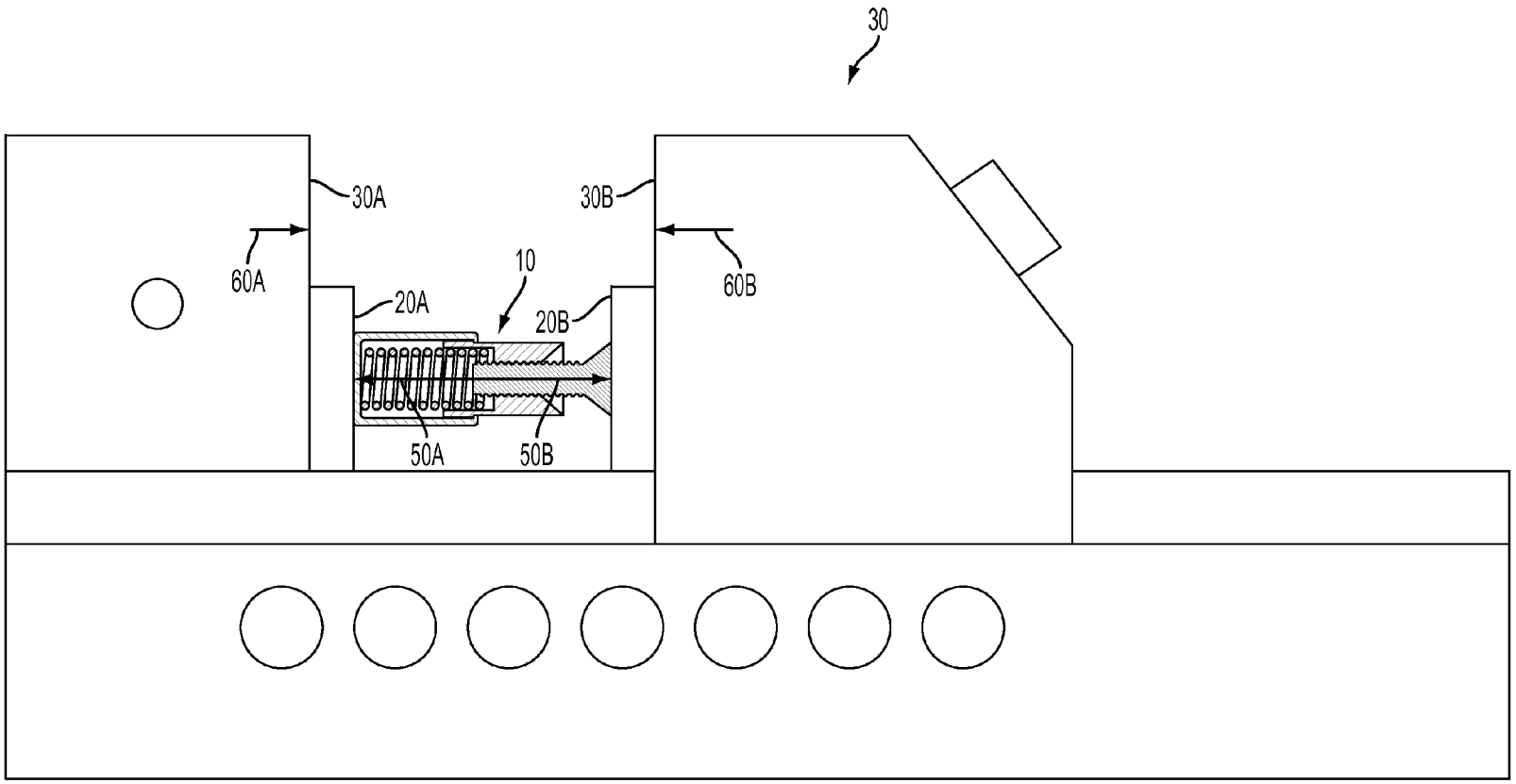
FIG. 1B is a cross-sectional view of a holder device in use.

Referring to FIGS. 1A and 1B, disclosed in this specification is a holder device (10) for retaining a pair of parallels (20A and 20B) against a pair of vise jaws (30A and 30B) comprising a compressible member (100) and an incompressible member (200). Further disclosed in this specification is a method for retaining a pair of parallels against a pair of vise jaws. Also disclosed in this specification is a holder device kit comprising a plurality of compressible members and a plurality of incompressible members.

As used in this specification and in the claims, compressible means that when a compressive force (60A and 60B) is applied to the member by closing the vise jaws, the member will deform, shrink, shorten, or collapse in at least the direction of the compressive forces, and that the member will re-expand and return to substantially its original shape and configuration when the compressive forces are removed such as by loosening the vise jaws. The member re-expanding and returning to substantially its original shape and configuration occurs when the member returns to a member length dimension that is within 5% of the original member length dimension prior to applying the compressive force to the member.

As used in this specification and in the claims, incompressible means that when a compressive force is applied to the member by closing the vise jaws, the member will not deform, shrink, shorten, or collapse. The member may deform by breaking or permanently bending in which case the member will generally not re-expand and/or return to substantially its original shape and configuration when the compressive forces are removed. If the incompressible member does break or permanently bend, returning the member to substantially its original shape and configuration would require some other mechanical means such as bending or welding which is beyond simply removing the compressive force.

Figure 2A:
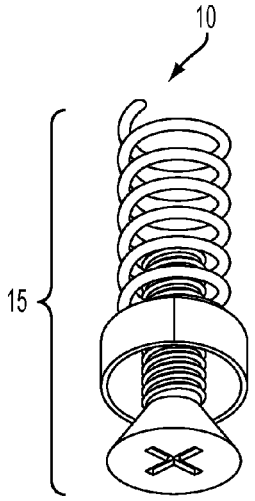
FIG. 2A is an assembled perspective view of one embodiment of the holder device.

Referring to FIGS. 2A (assembled) and 2B (disassembled), the compressible member (100) comprises a compressible member first end (110), a compressible member second end (120) that is opposite the compressible member first end, and a compressible member uncompressed length dimension (130) which is the length spanning between the compressible member first end and the compressible member second end when there is no compressive force applied to the compressible member. As used herein and in the claims, the term "length" or "length dimension" refers to a dimension that is perpendicular or substantially perpendicular to the pair of parallels as they are used in the vise against the opposing vise jaws.

Figure 2B:
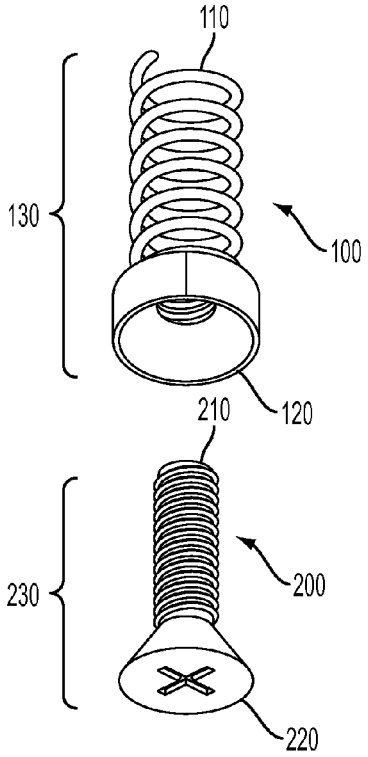
FIG. 2B is a disassembled perspective view of one embodiment of the holder device.

The incompressible member (200) comprises an incompressible member first end (210), an incompressible member second end (220) that is opposite the incompressible member first end, and an incompressible member length dimension (230) which is the length spanning between the incompressible member first end and the incompressible member second end as shown in FIG. 2B.

In one embodiment, the compressible member is a spring and the incompressible member is a rod. The rod may be connected to the spring by any known connection mechanism such as welding, gluing, soldering, or the like.

In one embodiment, the connection between the rod and the spring may also be a threaded connection such as that shown in FIGS. 2A (assembled) and 2B (disassembled) where the spring comprises female threads on the compressible member second end and the rod comprises male threads starting on the incompressible member first end and running at least a portion of the incompressible member length dimension. Examples of such a rod include a screw or a bolt. The male threads of the rod (screw or bolt) are mated to the female threads of the spring so as to connect the rod to the spring in a manner such that the holder device length dimension (15) can be varied.

In such an embodiment, it is preferred that the spring have an inside diameter that is greater than the outside diameter of the incompressible member, including the incompressible member threads. If the spring has an inside diameter that is less than the outside diameter of the incompressible member then the incompressible member cannot advance beyond the spring as it will jam against the spring.

Alternatively, the spring may comprise male threads on the compressible member second end and the rod may comprise female threads starting on the incompressible member first end and running at least a portion of the incompressible member length dimension. The female threads of the rod are mated to the male threads of the spring so as to connect the rod to the spring in a manner such that the holder device length dimension (15) can be varied.

Figure 3A:
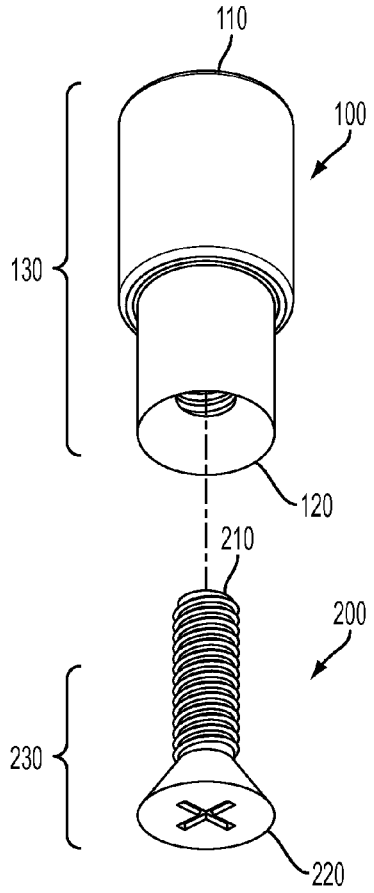
FIG. 3A is a disassembled perspective view of one embodiment of the holder device.
Figure 3B:
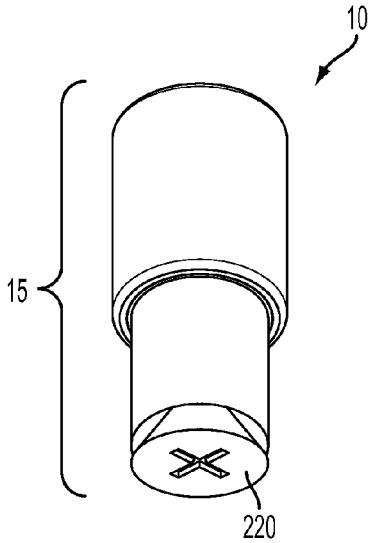
FIG. 3B is an assembled perspective view of one embodiment of the holder device.
Figure 3C:
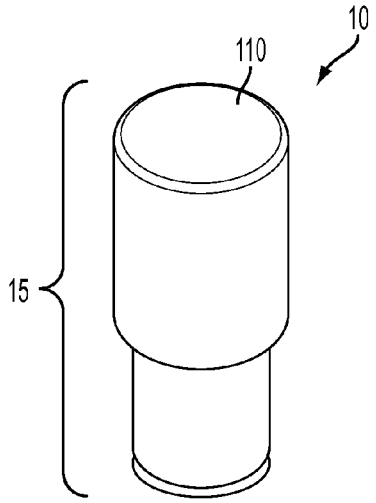
FIG. 3C is an assembled perspective view of one embodiment of the holder device.

Referring to FIGS. 3A, 3B, and 3C, the compressible member second end (120) is connected to the incompressible member first end (210) to form the holder device (10) having a holder device length dimension (15) which is the distance between the compressible member first end (110) and the incompressible member second end (220). In one embodiment, the connection between the compressible member second end and the incompressible member first end is an adjustable connection. An adjustable connection allows the holder device length dimension to be varied to fit between the parallels.

One such adjustable connection can be made by providing threads starting at the incompressible member first end (210) and running at least a portion of the incompressible member length dimension (230). The incompressible member threads are then mated to threads on the compressible member second end (120). In one embodiment, the compressible member second end comprises female threads, the incompressible member comprises male threads beginning at the incompressible member first end and running at least a portion of the incompressible member length dimension, and the male threads of the incompressible member are mated to the female threads of the compressible member second end. In another embodiment, the compressible member second end comprises male threads, the incompressible member comprises female threads beginning at the incompressible member first end and running at least a portion of the incompressible member length dimension, and the female threads of the incompressible member are mated to the male threads of the compressible member second end.

As used in this specification and in the claims, the terms "mated to" or "mated with" are synonymous when discussing the threads of one component mated to or mated with the threads of another component. The term "mated to" or "mated with" means that the threads of the two components are appropriately designed in terms of pitch, threads per inch, thread width, and thread depth so that the component having male threads can be advanced into the component having female threads by screwing the component having male threads into the component having female threads. The two components are thus connected with each other meaning that the component having male threads has been advanced into the component having female threads.

Male threads are those threads which are on the outer surface of a generally cylindrical component. Female threads are those threads which are on the inner surface of a generally circular hole. In one embodiment the male threads may be on the outer corners of a square component. When mated, the outside diameter of the cylinder having the male threads, not including the depth of the male threads, is less than the inside diameter of the cylinder having the female threads, not including the depth of the female threads.

Figure 4:
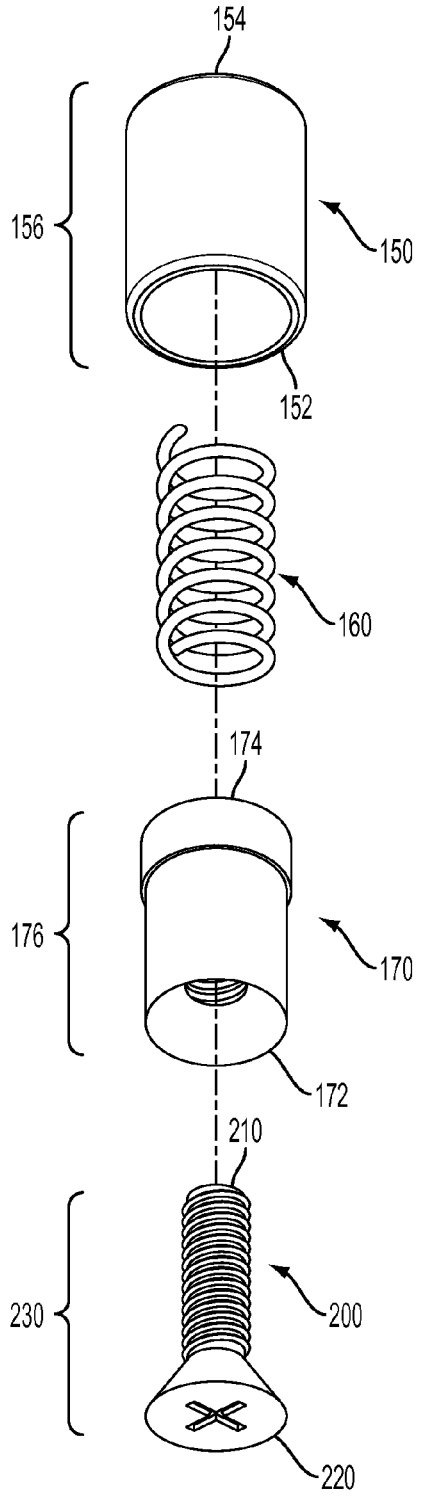
FIG. 4 is an exploded view of one embodiment of the holder device.

In another embodiment as seen in FIG. 4, the compressible member (100) comprises a housing (150), a spring (160), and a plunger (170). In such an embodiment the housing comprises a housing first end (152), a housing second end (154), (when assembled the housing second end (154) is the compressible member first end (110)) that is opposite the housing first end, and a housing length dimension (156) which is the length spanning between the housing first end and the housing second end. Similarly, the plunger comprises a plunger first end (172), (when assembled the plunger first end (172) is the compressible member second end (120)), a plunger second end (174) that is opposite the plunger first end, and a plunger length dimension (176) which is the length spanning between the plunger first end and the plunger second end. In such an embodiment, the housing first end (152) encompasses the plunger second end (174) while the housing encompasses the spring.

Figure 5:
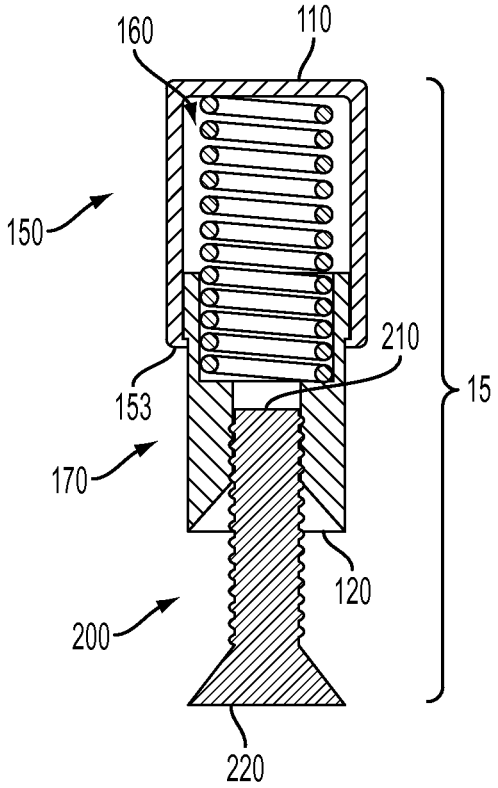
FIG. 5 is a cross-sectional view of one embodiment of the holder device.

As shown in FIG. 5, the housing first end may further comprise a lip (153) extending inwardly from the perimeter of the housing first end while the plunger second end may comprise a lip extending outwardly from the perimeter of the plunger second end. When the holder device is not under compressive forces the lip on the plunger second end rests against the lip on the housing first end, thereby preventing the plunger from exiting the housing. When the holder device is under compressive forces, the plunger second end interacts with the spring inside of the housing with the compression of the spring providing the retaining forces that hold the pair of parallels in place. In one embodiment, the plunger second end may be connected to the spring such as by welding or gluing the plunger second end to the spring, or by injection molding the plunger second end around a portion of the spring. As shown in FIG. 4, the plunger first end (172) may be countersunk to accept a tapered head of a bolt or screw.

In such an embodiment, it is preferred that the spring have an inside diameter that is greater than the outside diameter of the incompressible member, including the incompressible member threads. If the spring has an inside diameter that is less than the outside diameter of the incompressible member then the incompressible member cannot advance beyond the spring as it will jam against the spring.

In another embodiment, the compressible member comprises a housing and plunger assembled so as to retain a compressible fluid, such as a gas, under pressure. When compressive forces are applied, the change in the volume defined by the housing and plunger shrinks increasing the pressure and holding the parallels in place.

As used in this specification and in the claims, the term "encompasses" means that the perimeter of the first component surrounds and holds within its perimeter a second component. For instance, as shown in FIG. 5 the perimeter of the housing (150) may encompass the spring (160). However, the spring may be longer than the length of the housing. In one embodiment, the housing may completely encompass the spring with the entire spring being held within and surrounded by the housing. In an alternative embodiment, the housing may partially encompass the spring with only a portion of the spring being held within and surrounded by the housing. It is preferred that the assembly of the housing and the plunger completely encompass the spring so as to prevent particulate matter from the machining process from building up between the spring coils which could damage the spring and/or limit its ability to compress.

In one embodiment as seen in FIG. 4, there are female threads on at least one of the housing second end (154) or the plunger first end (172) while the incompressible member (200) is a rod having male threads starting at the incompressible member first end (210) and running at least a portion of the incompressible member length dimension (230). The male threads of the incompressible member mate with the female threads of the housing or plunger so as to connect the incompressible member to the compressible member in a manner such that the holder device length dimension can be varied.

Preferably the hole associated with the female threads is in the center of the housing second end or plunger first end and the spring has an inside diameter that is larger than the outside diameter of the incompressible member so that the incompressible member can be advanced through the spring providing more adjustment length.

It is preferable that the incompressible member has a relatively large flat surface as its second end, and the compressible member has a relatively large flat surface as its first end. The large flat surface may be in any shape, such as a circle, an oval, a square, a rectangle, a pentagon, a hexagon, an octagon, or the like. Preferably the large flat surface has a surface area of at least 0.25 $in^2$. The large flat surface distributes the retaining force in opposition of the compressive force across a larger area of the parallels so that the parallels do not move or rock about the holding device in the plane formed by the two vise jaws.

In one embodiment, the incompressible member second end and/or the compressible member first end may comprises multiple points such that each point of the multiple points contacts the parallels at a different position on the respective parallel, thereby distributing the compressive force across a larger area of the respective parallel.

Figure 6:
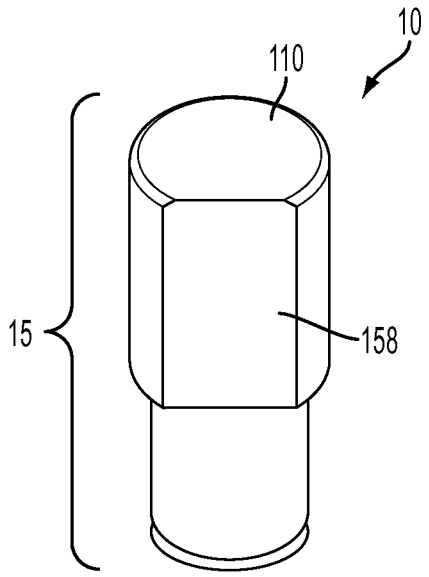
FIG. 6 is a perspective view of one embodiment of the holder device.

In one embodiment comprising a housing (150), a spring (160), and a plunger (170), the housing has an outside perimeter that is circular. In a further embodiment as shown in FIG. 6, the housing has an outside perimeter that is not circular. In such an embodiment the housing may have an outside perimeter that is square, rectangular, ovular, pentagonal, hexagonal, octagonal, or the like. It is preferred that the housing have at least one flat side (158) in a direction parallel to the housing length dimension. In practice, a housing having at least one flat side in a direction parallel to the housing length dimension reduces the ability of the holder device to roll when not in use.

Referring to FIGS. 1A and 1B, the holder device (10) is capable of providing a first retaining force (50A) on a first parallel (20A) of the pair of parallels in a first direction perpendicular to said first parallel while simultaneously providing a second retaining force (50B) on a second parallel (20B) of the pair of parallels in a second direction perpendicular to said second parallel and opposite the direction of said first retaining force when the holder device is compressed between the parallels against the pair of vise jaws (30A and 30B respectively). In this manner, the pair of parallels are held securely against the pair of vise jaws by the first retaining force and the second retaining force.

The method of retaining a pair of parallels comprises the steps of: (A) placing a holder device (10) comprising a compressible member (100) and an incompressible member (200) between a pair of parallels (20A and 20B) wherein the pair of parallels are adjacent to a pair of vise jaws (30A and 30B), (B) placing a work-piece on top of the pair of parallels, and (C) tightening the pair of vise jaws until the work-piece is held securely between the pair of vise-jaws on top of the pair of parallels and the compressible member is compressed to a compressible member compressed length dimension that is less than 100% of the compressible member uncompressed length dimension. The compressible member compressed length dimension is preferably in a range selected from the group consisting of between 5% and 95% of the compressible member uncompressed length dimension, between 10% and 90% of the compressible member uncompressed length dimension, between 15% and 85% of the compressible member uncompressed length dimension, between 20% and 80% of the compressible member uncompressed length dimension, between 25% and 75% of the compressible member uncompressed length dimension, between 30% and 70% of the compressible member uncompressed length dimension, between 35% and 65% of the compressible member uncompressed length dimension, between 40% and 60% of the compressible member uncompressed length dimension, and between 45% and 55% of the compressible member uncompressed length dimension.

In one embodiment of the method, the holder device comprises an adjustable connection between the compressible member and the incompressible member. In such an embodiment, the method may further include the step of adjusting the holder device length dimension to a length such that the incompressible member second end is in contact with the first parallel and the compressible member first end is in contact with the second parallel prior to tightening the pair of vise jaws. This step may occur prior to placing the work-piece on top of the pair of parallels or after placing the work-piece on top of the pair of parallels.

Figure 7A:
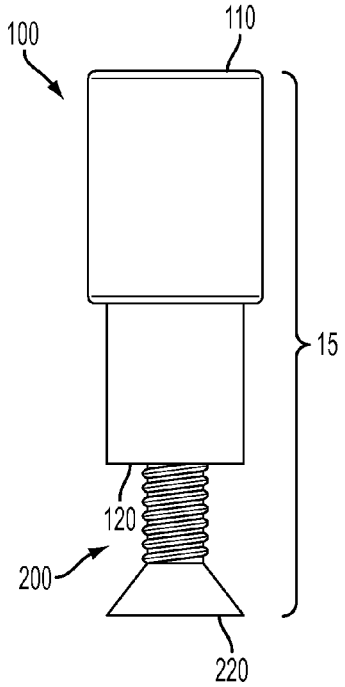
FIG. 7A is a side view of one embodiment of the holder device.
Figure 7B:
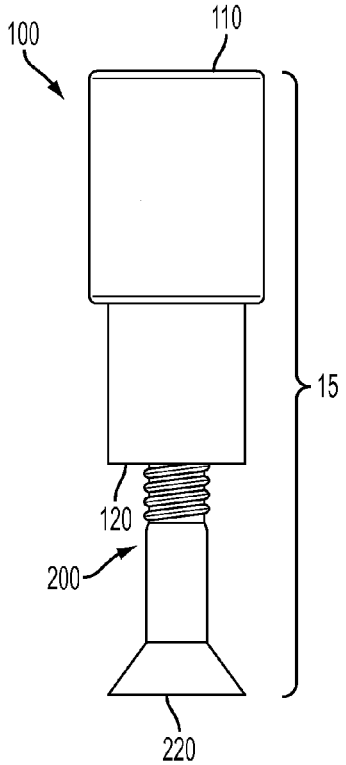
FIG. 7B is a side view of one embodiment of the holder device.
Figure 7C:
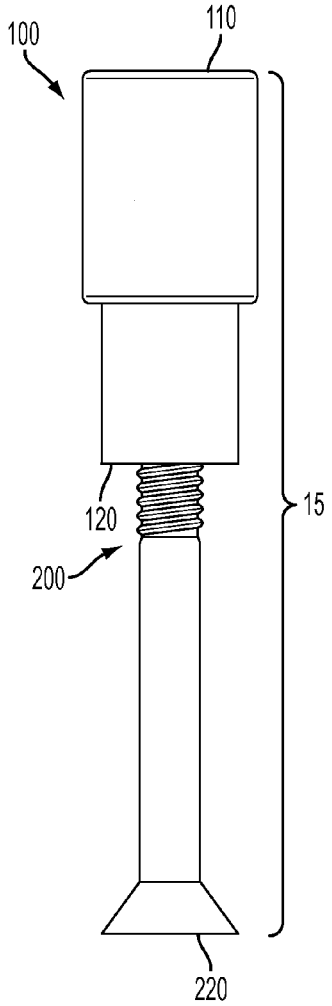
FIG. 7C is a side view of one embodiment of the holder device.

FIGS. 7A, 7B, and 7C demonstrate the versatility of the device showing that the holder device length dimension (15) can be varied for use with a variety of vise jaw widths by way of selecting a longer incompressible member (bolt or screw).

Figure 8:
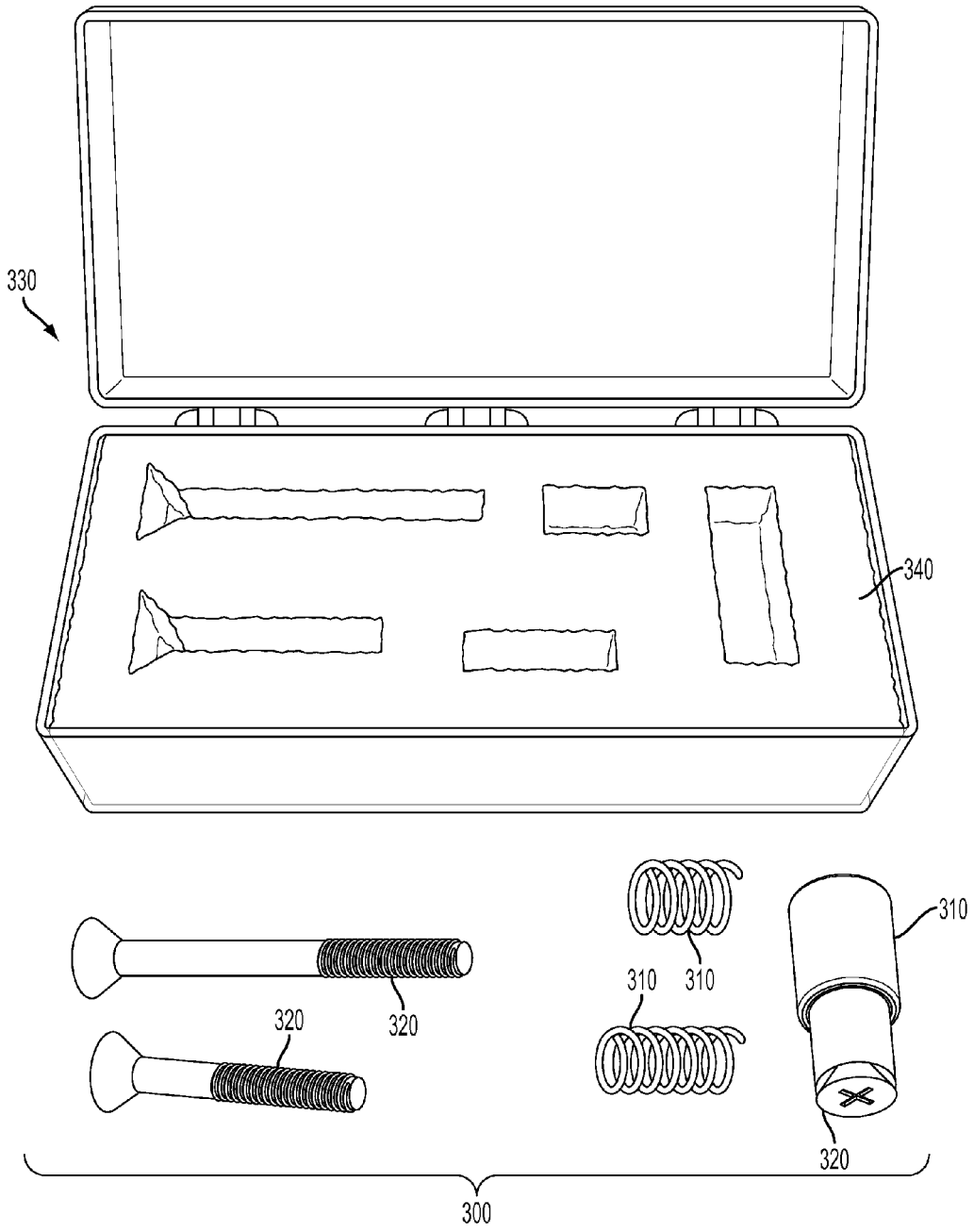
FIG. 8 is a perspective view of a holder device kit.

Referring to FIG. 8, a vise parallel retaining device kit (300) comprises at least one compressible member (310), a plurality of incompressible members (320), and a box (330) comprising a storage material (340) for storing the same. The plurality of compressible members is selected from the group consisting of one or more springs, one or more compressible members comprising a housing, a spring and a plunger, or combinations thereof. The plurality of incompressible members is selected from the group consisting of one or more rods, one or more screws, or combinations thereof. The box is made of any rigid material and preferably has a lid that can be opened and closed. The storage material is preferably foam, Styrofoam, or the like with a plurality of depressions with each of the depressions adapted to hold one or more of the compressible members and/or incompressible members.

In one embodiment the plurality of incompressible members comprises at least two incompressible members of varying incompressible member length dimensions and the at least one compressible member comprises at least two compressible members of varying compressible member uncompressed length dimensions. Each of the plurality of incompressible members is adapted to connect to the each of the at least one compressible members as described herein. Each of the plurality of compressible members in the kit should have a compressible member uncompressed length dimension in the range of between 0.5 inches and 7 inches. Each of the plurality of incompressible members in the kit should have an incompressible member length dimension in the range of between 0.5 and 7 inches. In this manner, the holder device length dimension can easily be varied to account for the size of the work-piece being machined ranging from small work-pieces requiring vise jaw widths of less than 2 inches to large work-pieces requiring vise jaw widths of 8 inches or greater.

By way of example, but not limitation, the kit may provide a compressible member having a compressible member uncompressed length dimension of 1.625 inches (4.13 cm) and a compressible member compressed length dimension of 1 inch (2.54 cm). The kit may further provide a number of incompressible members having varying incompressible member length dimensions. For example, the incompressible members may have incompressible member length dimensions of 1 inch (2.54 cm), 2 inches (5.08 cm), and 3 inches (7.62 cm). Each of the incompressible members in the kit will be threaded beginning at the incompressible member first end and running a distance of 0.625 inches (1.59 cm), this dimension being known as the thread length. The thread length is preferably selected so that the incompressible member cannot be threaded into or onto the compressible member at a length greater than the difference between the compressible member uncompressed length dimension and the compressible member compressed length dimension. For example, if the compressible member uncompressed length dimension is 1.625 inches (4.13 cm), and the compressible member uncompressed length dimension is 1 inch (2.54 cm), the thread length should be no greater than 0.625 inches (1.59 cm). In such an example, if the thread length is greater than 0.625 inches (1.59 cm), the incompressible member may "bottom out" when the vise jaws are tightened, thereby unnecessarily limiting the amount that the holder device can be compressed. The holder device length dimension can be varied to adapt to varying vise jaw widths by selecting the proper incompressible member from the kit (1 inch (2.54 cm), 2 inches (5.08 cm), 3 inches (7.62 cm), etc.) and/or by adjusting the amount of the incompressible member that is threaded into or onto the compressible member. In the current example, the kit could be used to retain parallels in a range of jaw widths as set forth in Table I below.

TABLE 1

| Range of vise jaw widths | | | | | | | | | | | | | |
|---|---|---|---|---|---|---|---|---|---|---|---|---|---|
| Compressible Member | | | | Incompressible Member | | | | Maximum Holder Device Length | | Minimum Holder Device | | | |
| Un-compressed Length | | Compressed Length | | Incompressible Member Length | | Thread Length | | (Un-compressed) | | Length (Compressed) | | Jaw Width Range | |
| inch | cm | inch | cm | inch | cm | inch | cm | inch | cm | inch | cm | inch | cm |
| 1.625 | 4.13 | 1 | 2.54 | 1 | 2.54 | 0.625 | 1.59 | 2.3 | 5.84 | 1.2 | 3.05 | 1.2 to 2.3 | 3.05 to 5.84 |
| 1.625 | 4.13 | 1 | 2.54 | 2 | 5.08 | 0.625 | 1.59 | 3.3 | 8.38 | 2.2 | 5.59 | 2.2 to 3.3 | 5.59 to 8.39 |
| 1.625 | 4.13 | 1 | 2.54 | 3 | 7.62 | 0.625 | 1.59 | 4.3 | 10.92 | 3.2 | 8.13 | 3.2 to 4.3 | 8.13 to 10.92 |

One can easily see how the holder device can be quickly and easily adapted to fit a variety of vise jaw widths.

Preferably the components that make up the holder device are made of durable materials that can withstand the various forces and particulate matter that they are subjected to during routine manufacturing applications. For instance the incompressible member, the rod, the housing, or the plunger may be made of metal or plastic materials. Preferred metal materials for the incompressible member, the rod, the housing, or the plunger include steel, hardened steel, and leaded steel. One preferred steel is 12L14 steel. Preferred plastic materials for the incompressible member, the rod, the housing or the plunger include polycarbonates, polyamides, and engineering grade thermoplastics. In one embodiment, the plastic materials may be reinforced using a filler material such as glass fibers, carbon fibers, polyaramide fibers, or combinations thereof. The spring, when used is preferably made of a spring steel. One preferred spring steel is stainless spring steel.

In one embodiment, the various components of the holder device may be coated to prevent rusting or corrosion. Preferred coatings include black phosphate coatings and black oxide coatings. Coatings, when used, can be applied to any of the components that make up the holder device including the incompressible member, the rod, the spring, the housing, and the plunger.

We claim:

1. A holder device capable of providing opposing retaining forces on a pair of parallels when the holder device is compressed between the pair of parallels against a pair of vise jaws, said holder device comprising:

a compressible member comprising a housing comprising a housing first end, a housing second end that is opposite said housing first end, and a housing length dimension;

a spring; and a plunger comprising a plunger first end, a plunger second end that is opposite said plunger first end, and a plunger length dimension, wherein the housing first end encompasses the plunger second end, the housing encompasses the spring, and the plunger second end interacts with the spring inside the housing when the holder device is under compressive forces;

a threaded incompressible adjustment member having a threaded incompressible adjustment member first end, a threaded incompressible adjustment member second end that is opposite said threaded incompressible adjustment member first end, and a threaded incompressible adjustment member length dimension; and wherein the threaded incompressible adjustment member first end is adjustably connected to the plunger first end to form the holder device having an adjustable holder device length dimension.

2. The holder device of claim 1, wherein there are female threads on at least one of the housing second end and the plunger first end, the threaded incompressible adjustment member is a rod having male threads starting on the threaded incompressible adjustment member first end and running at least a portion of the threaded incompressible adjustment member length dimension, and the female threads are mated to the male threads.

3. The holder device of claim 2, wherein the housing has an outside perimeter which is not circular.

4. The holder device of claim 3, wherein the housing has at least one flat side in a direction parallel to the housing length dimension.

5. The holder device of claim 1, wherein the housing has an outside perimeter which is not circular.

6. The holder device of claim 5, wherein the housing has at least one flat side in a direction parallel to the housing length dimension.

7. The holder device of claim 1, wherein the threaded incompressible adjustment member is made of a material selected from the group consisting of metal or plastic.

8. The holder device of claim 7, wherein the threaded incompressible adjustment member further comprises a coating.

9. The holder device of claim 8, wherein the coating is selected from the group consisting of black phosphate coatings and black oxide coatings.

10. The holder device of claim 1, wherein the housing and the plunger are made of a material selected from the group consisting of metal or plastic.

11. The holder device of claim 10, wherein the housing and the plunger further comprise a coating.

12. The holder device of claim 11, wherein the coating is selected from the group consisting of black phosphate coatings and black oxide coatings.

13. The holder device of claim 12, wherein the incompressible member is made of a material selected from the group consisting of metal or plastic.

* * * * *